US005255246A

United States Patent [19]

van Halteren

[11] Patent Number: 5,255,246

[45] Date of Patent: Oct. 19, 1993

[54] ELECTROACOUSTIC TRANSDUCER OF THE ELECTRET TYPE

[75] Inventor: Aart Z. van Halteren, Hobrede, Netherlands

[73] Assignee: Siemens Nederland N.V., Den Haag, Netherlands

[21] Appl. No.: 945,918

[22] Filed: Sep. 17, 1992

[30] Foreign Application Priority Data

Sep. 17, 1991 [NL] Netherlands ..... 9101563

[51] Int. Cl.[5] ..... H04R 19/00

[52] U.S. Cl. ..... 367/170; 367/181; 381/174; 381/191

[58] Field of Search ..... 367/170, 181; 381/174, 381/191

[56] References Cited

U.S. PATENT DOCUMENTS 4,063,050 12/1977 Carlson et al. ..... 179/111
4,730,283 3/1988 Carlson et al. ..... 367/181

FOREIGN PATENT DOCUMENTS 0194958 9/1986 European Pat. Off. .
WO84/00662 2/1984 PCT Int'l Appl. .
WO88/02208 3/1988 PCT Int'l Appl. .

*Primary Examiner*—J. Woodrow Eldred
*Attorney, Agent, or Firm*—Brady, O'Boyle & Gates

[57] ABSTRACT

An electroacoustic transducer of the electret type, comprising a case (101) having an opening (102) via which the interior of the case communicates with the surroundings; a backplate (105) and a diaphragm (107) arranged opposite the backplate in the case, the surface of the backplate being provided at least partly with an electret material (106) and at least a part of the surface of the diaphragm being provided with an electrically conductive layer (110); and an annular element (109) for securing the circumference of the diaphragm to the inside wall of the case. According to the invention, the parasitic capacity between the backplate (105) and the annular element (109) is eliminated in that the backplate and the annular element are both electrically connected with the case and thereby have the same potential as the case. This also provides production-technical advantages.

14 Claims, 10 Drawing Sheets

ELECTROACOUSTIC TRANSDUCER OF THE ELECTRET TYPE

This invention relates to an electroacoustic transducer of the electret type, comprising a case having an opening via which the interior of the case communicates with the surroundings; a backplate and a diaphragm arranged opposite the backplate in the case, the surface of the backplate being provided at least partly with an electret material and at least a part of the surface of the diaphragm being provided with an electrically conductive layer; and means for securing the circumference of the diaphragm to the inside wall of the case.

Such a transducer, which is particularly suitable to be used in hearing-aids, is disclosed in U.S. Pat. No. 4,063,050 and in U.S. Pat. No. 4,730,283.

With such transducers, it is always a problem to minimize the parasitic capacitances, i.e., the capacitances that do not vary proportionally to the variation in the air vibrations but are stationary and are determined by the construction of the transducer. One of these parasitic capacitances is the capacitance between the backplate and the means for affixing the diaphragm to the inside wall of the case, which means, in the construction disclosed in the U.S. patent specifications referred to, consist of an annular member that is electrically connected with the diaphragm.

With the transducer disclosed in U.S. Pat. No. 4,730,283, it is endeavored to reduce the parasitic capacitance between the backplate and the means for affixing the diaphragm to the case relative to the parasitic capacitance such as is present in the transducer according to U.S. Pat. No. 4,063,050.

To that end, it is endeavored to provide a largest possible distance between the circumferential edge of the backplate and the annular member. In the known transducer, the diaphragm is arranged at the bottom of the case and an upright edge of the diaphragm is affixed to the inside wall of the case using the annular member. The backplate is placed on the diaphragm, whilst protrusions formed in the backplate and projecting towards the bottom of the case rest on protrusions formed in the bottom and projecting upwards, so as to effect the desired distance between the diaphragm and the backplate. To fix the backplate in the case, the backplate is connected at the corners thereof to the annular member by means of an electrically non-conductive material, such as glue.

A first drawback of the transducer known from U.S. Pat. No. 4,730,283 is that although the parasitic capacitance between the ring and the backplate is reduced, it still remains present. A further drawback of the known transducer is that the assembly thereof is troublesome in practice and consequently renders fabrication in large numbers difficult.

The object of the invention is to provide a transducer in which the parasitic capacitance mentioned no longer has any influence whatsoever on the transfer characteristic of the transducer, whilst the other parasitic capacitances are also minimized, and which transducer can moreover be fabricated in a considerably simpler manner.

To that effect, the invention provides a transducer of the type mentioned above, in which the backplate and the means for securing the diaphragm to the inside wall of the case are both electrically connected with the case and thereby have the same potential as the case.

The parts which together may form a (parasitic) capacitance actually function as capacitance only when there is a difference in potential between these parts. By virtue of the features according to the invention, therefore, the parasitic capacitance between the backplate and the affixing means for the diaphragm is eliminated entirely.

Also, owing to the features of the invention, the fabrication of the transducer is simpler because first the backplate can be mounted on the bottom of the case and then the diaphragm can simply be placed and mounted on top of the annular member, the positioning of the backplate relative to the annular member being critical no longer. It is also possible first to manufacture a large number of backplate/diaphragm assemblies together and then to mount them each separately in a case.

To further reduce the parasitic capacitances, according to a preferred embodiment of the invention, no use is made of protrusions in the backplate for spacing the backplate and the diaphragm, but use is made of cam-shaped members of an electrically insulating material, such as Kapton, provided on the backplate. It is observed that the use of such cam-shaped members is known per se from applicant's U.S. Pat. No. 4,567,382.

The invention will hereinafter be further explained and illustrated with reference to the accompanying drawings, wherein.

Figure 1:
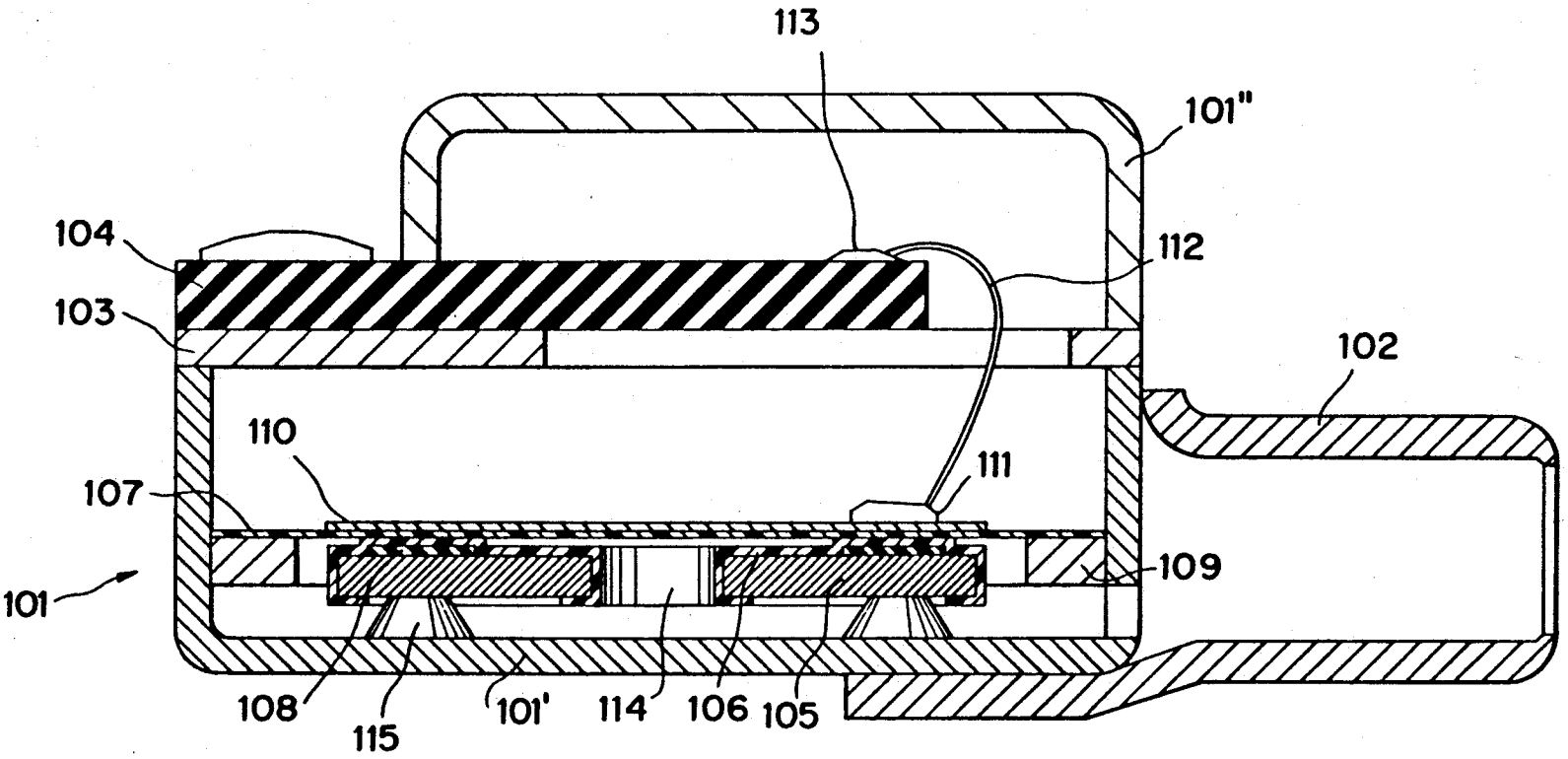
FIG. 1 is a side elevation in cross-section of a first embodiment of the transducer according to the invention.

The figures show various embodiments of transducers which are suitable for use in hearing-aids, the operation of these transducers being based on the change in the capacitance between a fixed electrode, the backplate, and a movable diaphragm under the influence of external air (sound) vibrations. The change in this capacitance is proportional to the changes in air pressure and can be converted into amplified sound vibrations via an electronic amplifier in a manner which is known per se. It is also possible to convert electrical signals into sound vibrations. Because the various embodiments comprise substantially identical parts, or at least parts with the same function, like parts in the different figures are indicated by like reference numerals, but preceded by the number of the figure. Parts that have the same function in different figures will be discussed only with reference to FIG. 1, whilst it can be assumed that, unless specified otherwise, these parts have the same form and function in the other embodiments.

Figure 2:
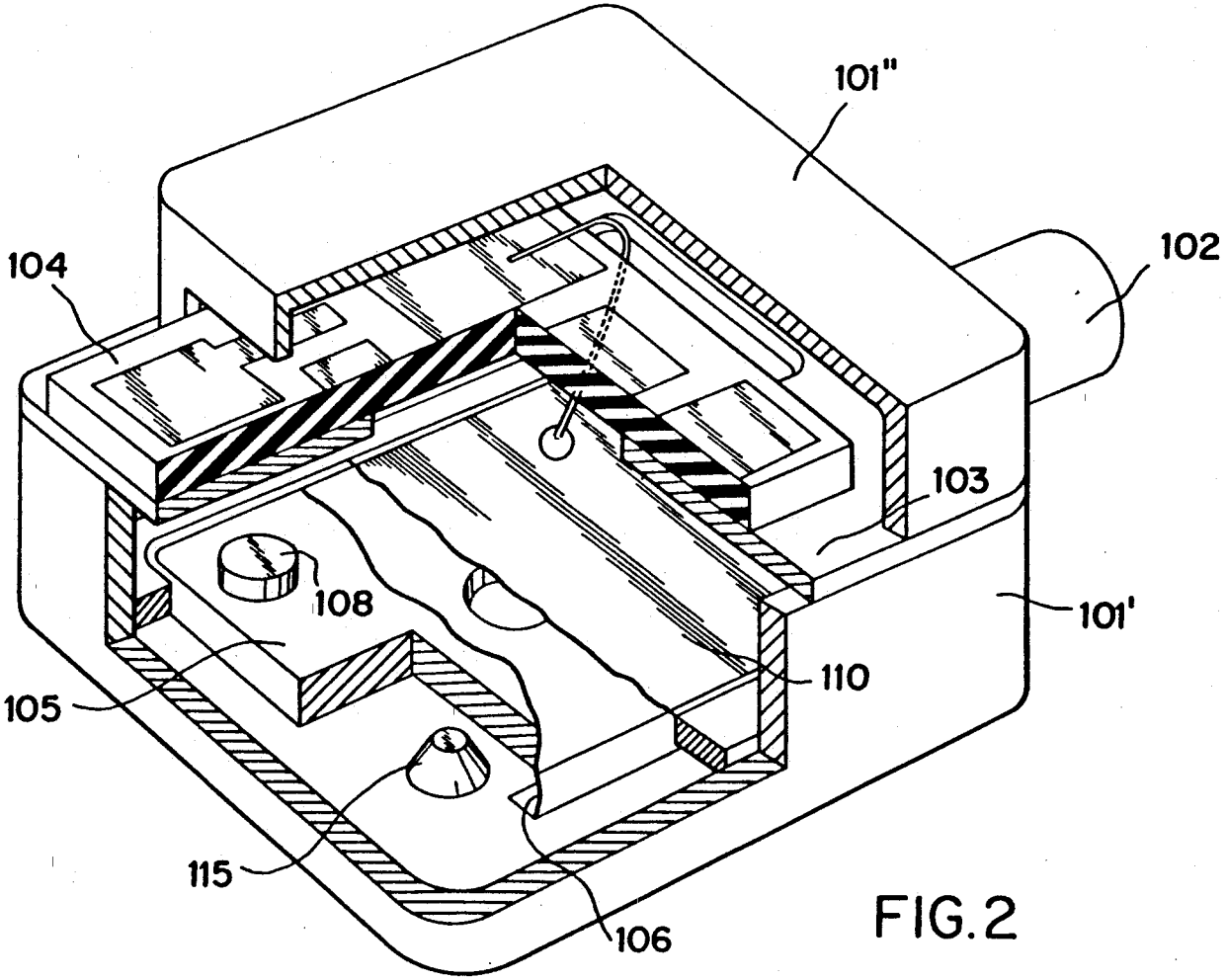
FIG. 2 is a perspective view of the transducer shown in FIG. 1.

FIGS. 1 and 2 show a case 101 for a transducer, comprising a lower case section 101', an upper case section or cover 101" and an inlet opening 102 via which the interior of the case communicates with the surroundings for air vibrations. Arranged between the upper and the lower case sections is a mounting plate 103 provided with an opening located within the case, for passing electrical connecting wires therethrough. Provided on the mounting plate 103 is a thick-film circuit 104 located partly within and partly without the case, this circuit 104 comprising an amplifier circuit required for converting and amplifying the changes in capacitance into an electrical signal representative of those changes.

Located within the case is the so-called backplate 105, which is at least partly surrounded by an electret material 106, such as Teflon. Located opposite at least a part of the portion of the backplate that has been coated with electret material is a diaphragm 107 which can be made of an insulating material that is suitable for this purpose, such as Mylar, in a manner known per se. The diaphragm 107 is kept at a predetermined distance from the backplate by means of cam-shaped members 108 made from an insulating material, such as Kapton. The circumferential edge of the diaphragm 107 is affixed to an annular support member 109 mounted to the inside wall of the case. This support member 109 is also electrically conductively connected to the case 101, for instance by means of welds. The electrically active portion of the diaphragm, i.e., the portion which, together with the backplate 105, determines the capacitance varying under the influence of air vibrations, is coated, for instance by evaporation, with an electrically conductive metal layer 110, for instance a gold layer. The metal layer 110 is connected via an electrically conductive contact material 111, for instance silver epoxy, via a wire 112, to a connection 113 on the thick-fim circuit 104.

The backplate 105 can in conventional manner be provided with through openings 114, capable of allowing air vibrations into the space under the diaphragm, whilst the backplate 105 is supported relative to the case 101 and electrically conductively connected therewith by means of projections 115 formed on the bottom of the case. If projections 115 do not consist of an electrically conductive material, the backplate is electrically connected to the case in a different manner.

Inasmuch as according to the invention the backplate 105 and the annular member 109 are both electrically conductively connected to the case, there is no capacitance present between these two parts and therefore no interfering parasitic capacitance effects can occur.

Figure 3:
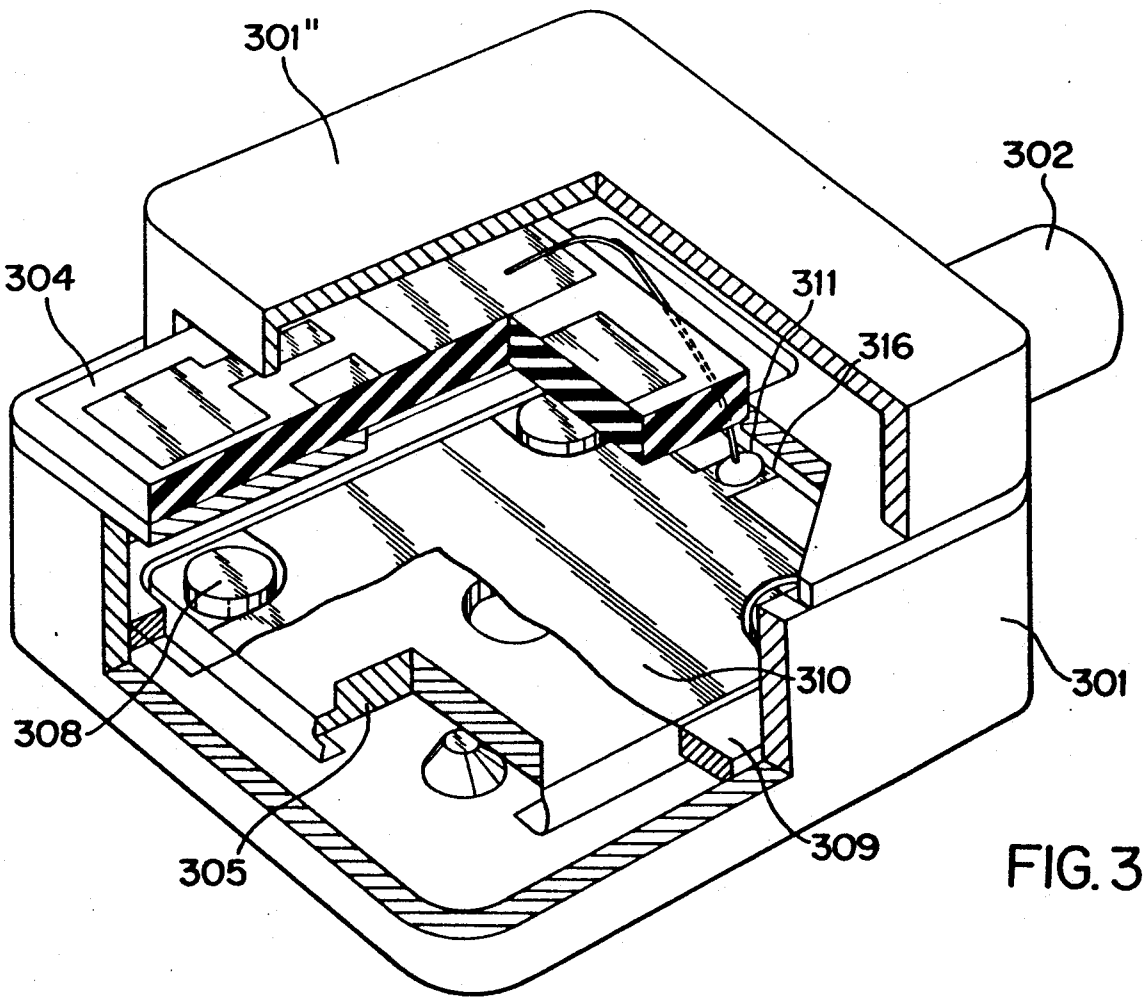
FIG. 3 is a perspective view of a second embodiment of the transducer according to the invention.

In a transducer of the subject type, parasitic capacitances are present wherever the capacitance formed by the backplate and the diaphragm cannot move under the influence of air vibrations. For that reason, it is also important to make the connection of the wire 112 to the diaphragm as small as possible. In the embodiment according to FIG. 1 this is already the case inasmuch as the contact 111 is positioned above a spacer 108, where the diaphragm cannot move anyway, and inasmuch as between the contact 111 and the backplate a dielectric consisting for instance of 25 μm Teflon and for instance 40 μm Kapton is present, which relatively large distance provides for a further reduction of the parasitic capacitance. Another possibility is shown in FIG. 3 wherein the metal layer 310 extends above the annular element 309 by a portion 316, with the contact provided on this portion 316. Because at the portion 316 only about 1–6 μm Mylar is present between the contact and the annular element 309, the capacitance can here be reduced still further by providing an additional dielectric material between the contact 111 and the annular element 309.

As shown in FIG. 3, the parasitic capacitance can be reduced still further by not providing an evaporated metal layer 310 above the cam-shaped elements 308, because the diaphragm cannot move above these elements and hence introduces undesired stationary capacitance. It is also possible to evaporate the metal layer above only one cam-shaped member and then to provide the contact 111 at that point in the manner shown in FIG. 1.

Figure 4:
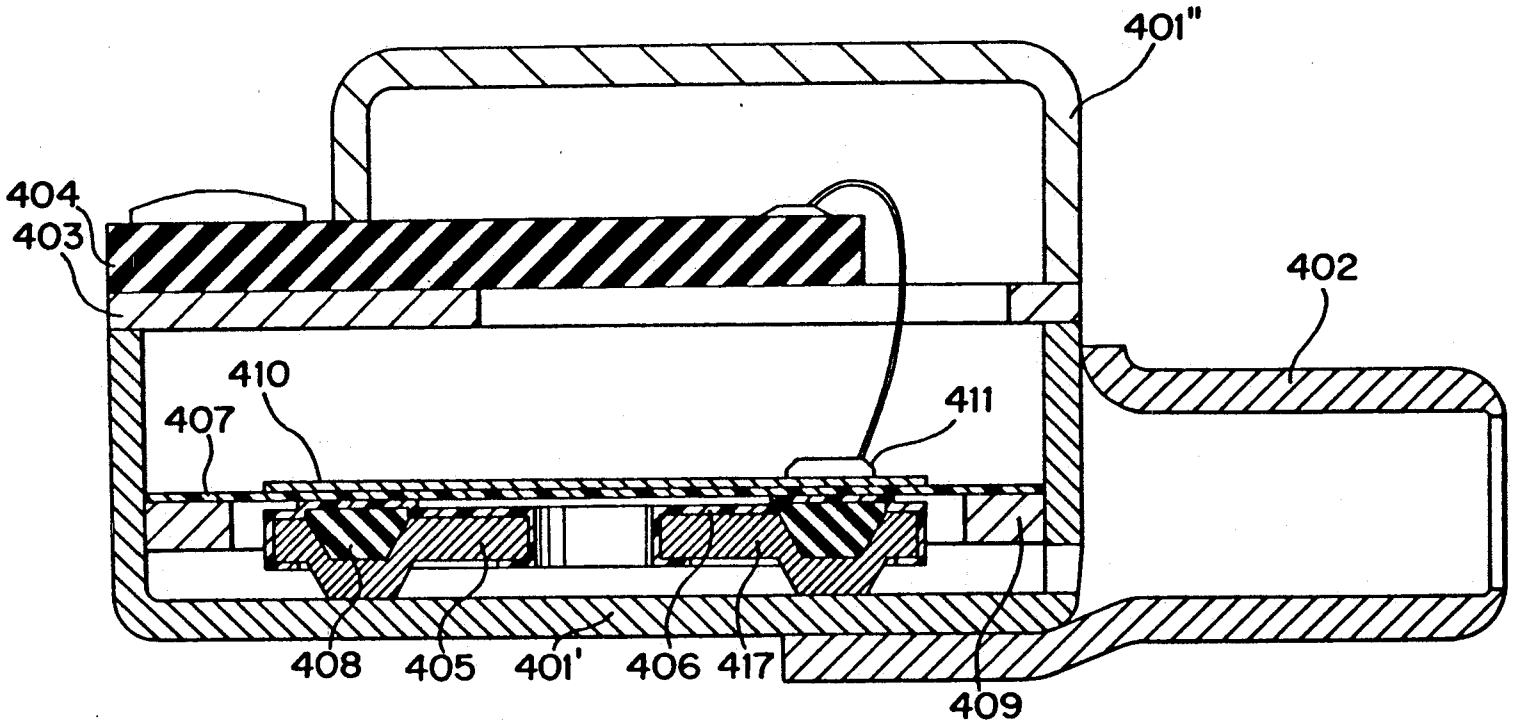
FIG. 4 is a side elevation in cross-section of a third embodiment of the transducer according to the invention.

FIG. 4 shows a variant 405 of the backplate, wherein this backplate is provided with deepened portions in which cam-shaped spacer elements 408 can be arranged. An advantage of this construction is that the distance between the diaphragm 407 and the backplate can be further reduced without further increasing the parasitic capacitance at that point. A small distance between diaphragm and backplate is favourable for obtaining a transducer of high sensitivity. In the embodiment according to FIG. 4, but also in that according to FIG. 1 or 3, the projections 115 can also be formed by projections 417 which are formed at the underside of the backplate 405.

Figure 5:
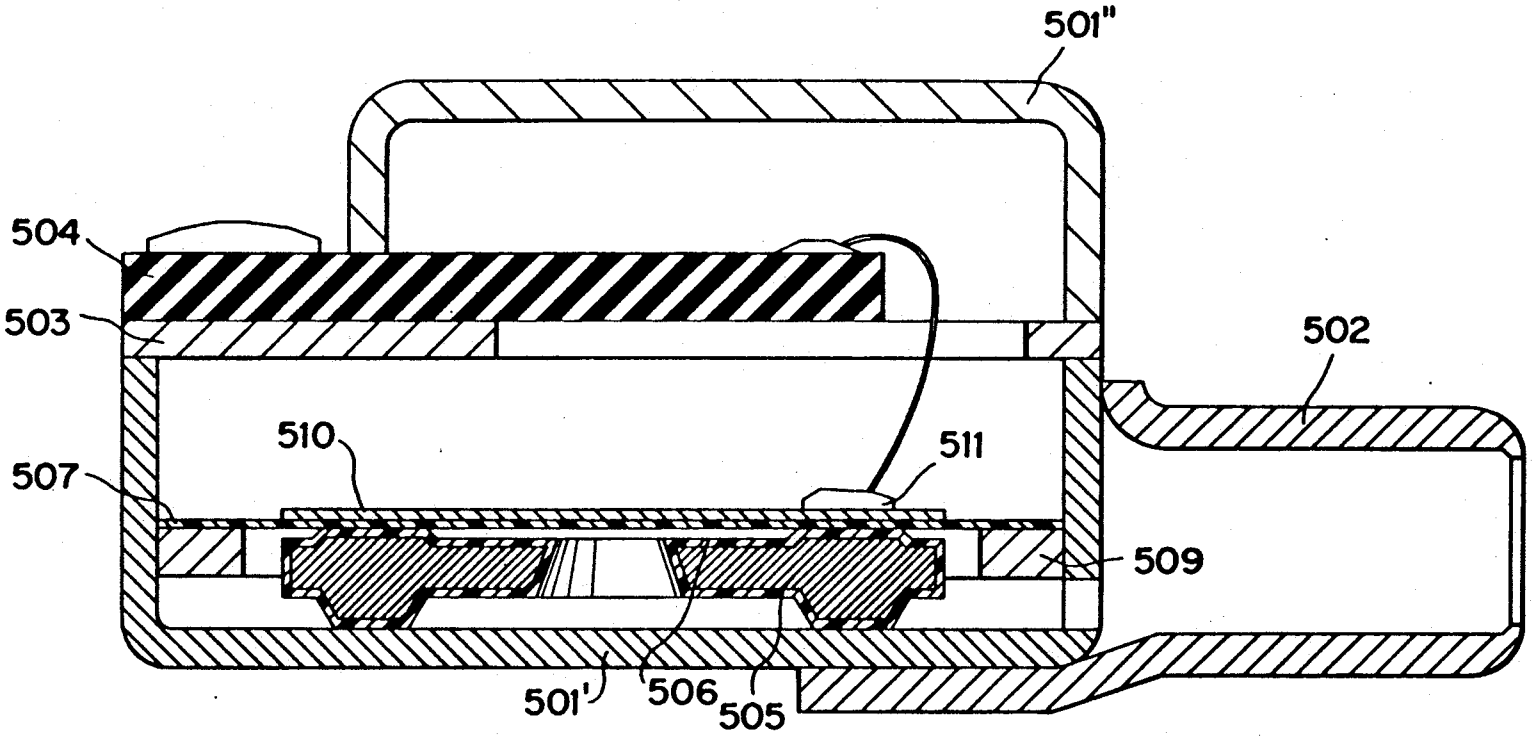
FIG. 5 is a side elevation in cross-section of a fourth embodiment of the transducer according to the invention.

As is the case in the embodiments according to FIGS. 1–4, the electret material 107, 307 and 407 can consist of Teflon which has been folded over the backplate proper, but if the backplate consists of Si, it can also be formed by $SiO_2$ which has been formed on the Si backplate by oxidation. An advantage hereof is that a large number of backplates can be formed simultaneously into a wafer and can be charged. A thus formed backplate 505 with electret material 506 is shown in FIG. 5.

Figure 6:
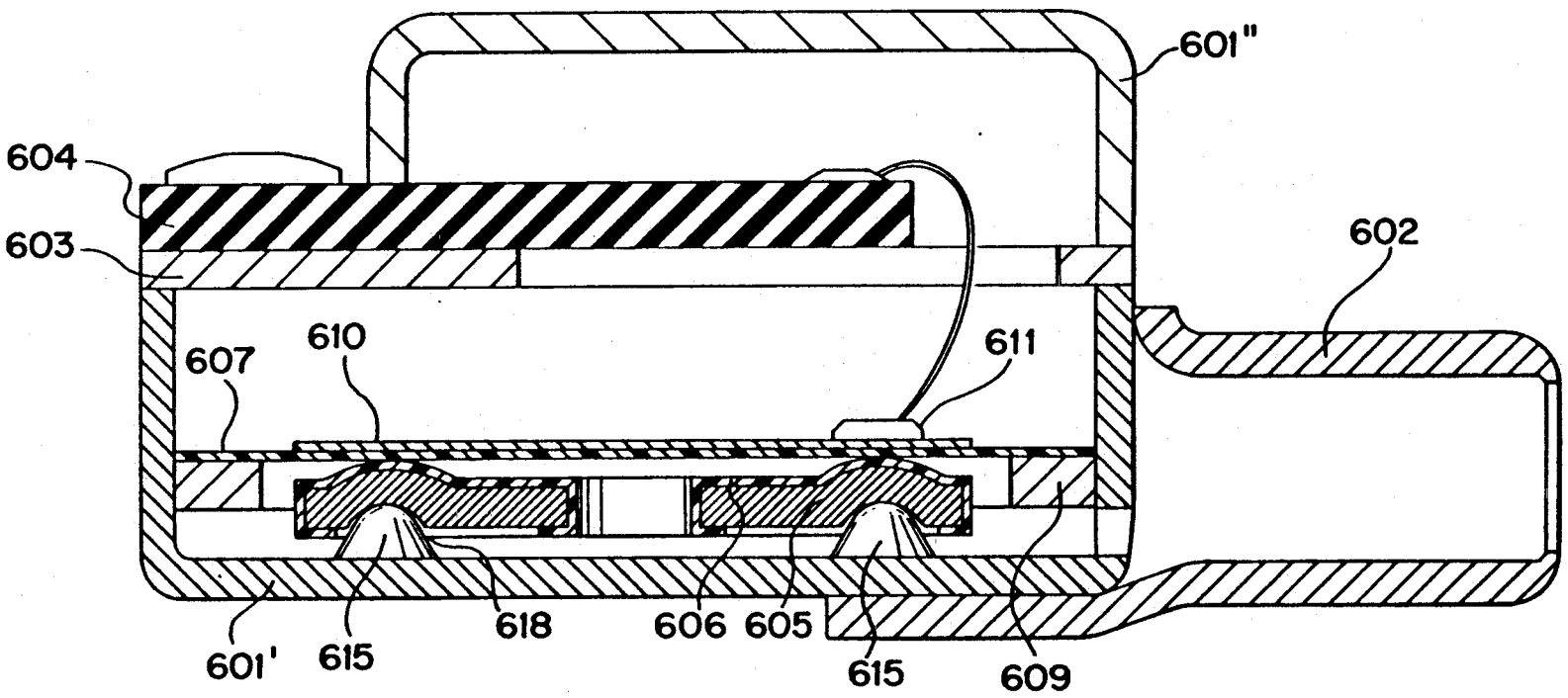
FIG. 6 is a side elevation in cross-section of a fifth embodiment of the transducer according to the invention.

FIG. 6 shows an embodiment which makes it possible to position the backplate 605 relative to the case in a simple manner. To that end, the underside of the backplate is provided with concave deepened portions 618 and the bottom with rounded spacer elements 615. Through the cooperation of the concave portions 618 and the projections 615, the backplate will always end up in the proper position in the case 601. A further advantage of the embodiment according to FIG. 6 is that the protrusions which are formed at the top of the backplate 605 as the concave portions 618 are formed can simultaneously function as spacers between the backplate and diaphragm 607, so that no separate spacer elements of Kapton are necessary.

Figure 7:
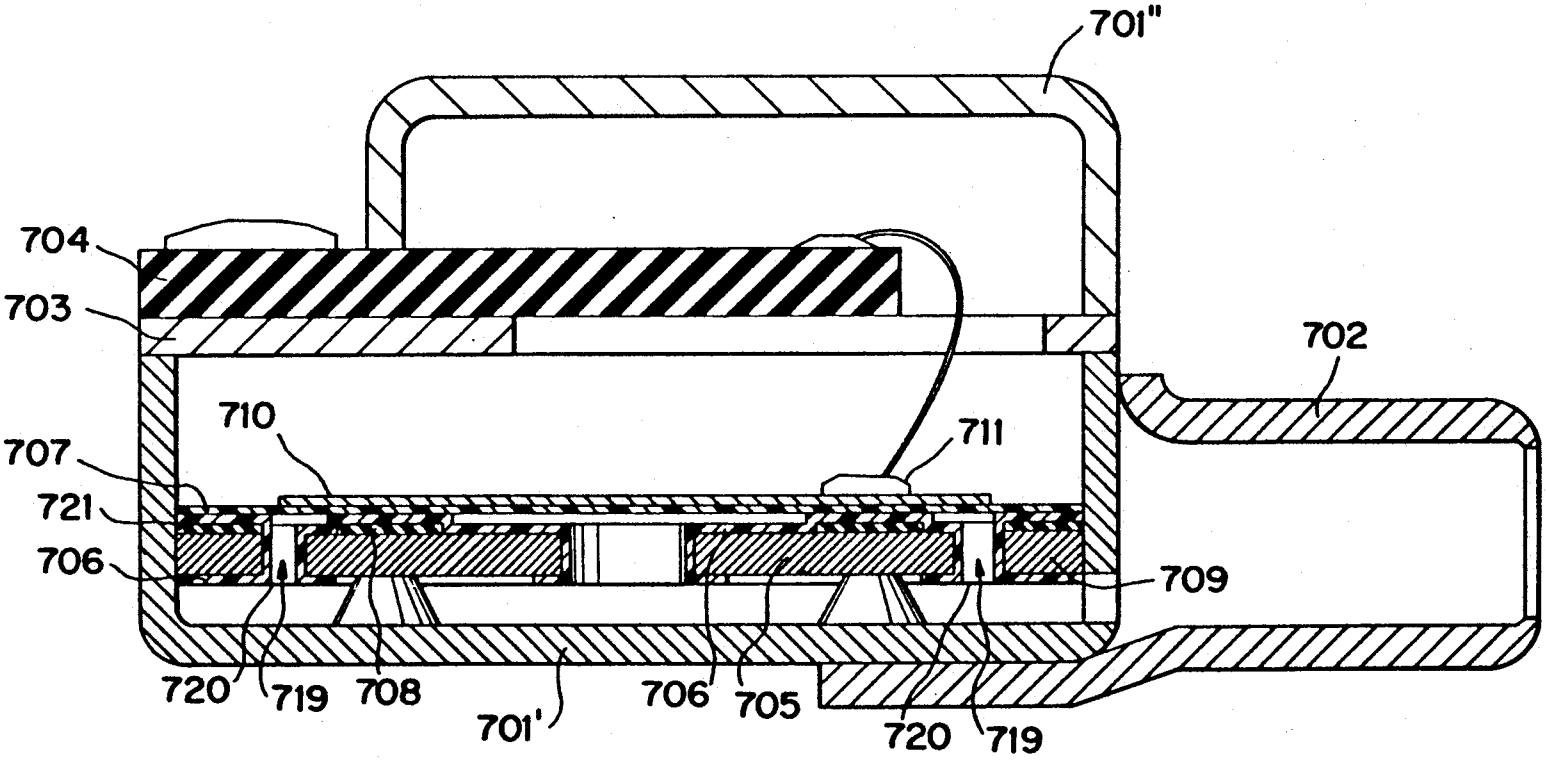
FIG. 7 is a side elevation in cross-section of a sixth embodiment of the transducer according to the invention.

FIG. 7 shows an embodiment in which the backplate 705 and the annular support 709 together are made from a metal sheet by punching openings in this sheet for the holes 714 in the backplate as well as slots 719 for mutually separating the backplate 705 and the annular support 709 except for a number of connecting ribs 720, for instance four, located in the corners. In this manner, such backplates can be formed simultaneously in large numbers from a large metal sheet. The spacer elements 708 of Kapton are arranged on the metal sheet and a frame-shaped element 721 of an insulating material, for instance likewise Kapton, of the size of the annular support 709 is provided on the annular support. Then the metal sheet is provided with the Teflon electret material. Finally, the diaphragm foil 707 is stretched over all backplates having the frames 721 provided thereon and fastened with glue at the location of the frames, whereafter the various backplate/diaphragm assemblies can be separated from each other for each of them to be separately built into a case 701.

In addition to the advantage of allowing batchwise fabrication of a large number of backplate/diaphragm assemblies, the embodiment according to FIG. 7 has the advantage that the annular support 709 is also coated with electret material and, accordingly, can be charged as well. Inasmuch as the metal layer on the diaphragm can extend over the annular element 709, the capacitor surface of the transducer can be enlarged.

Figure 8:
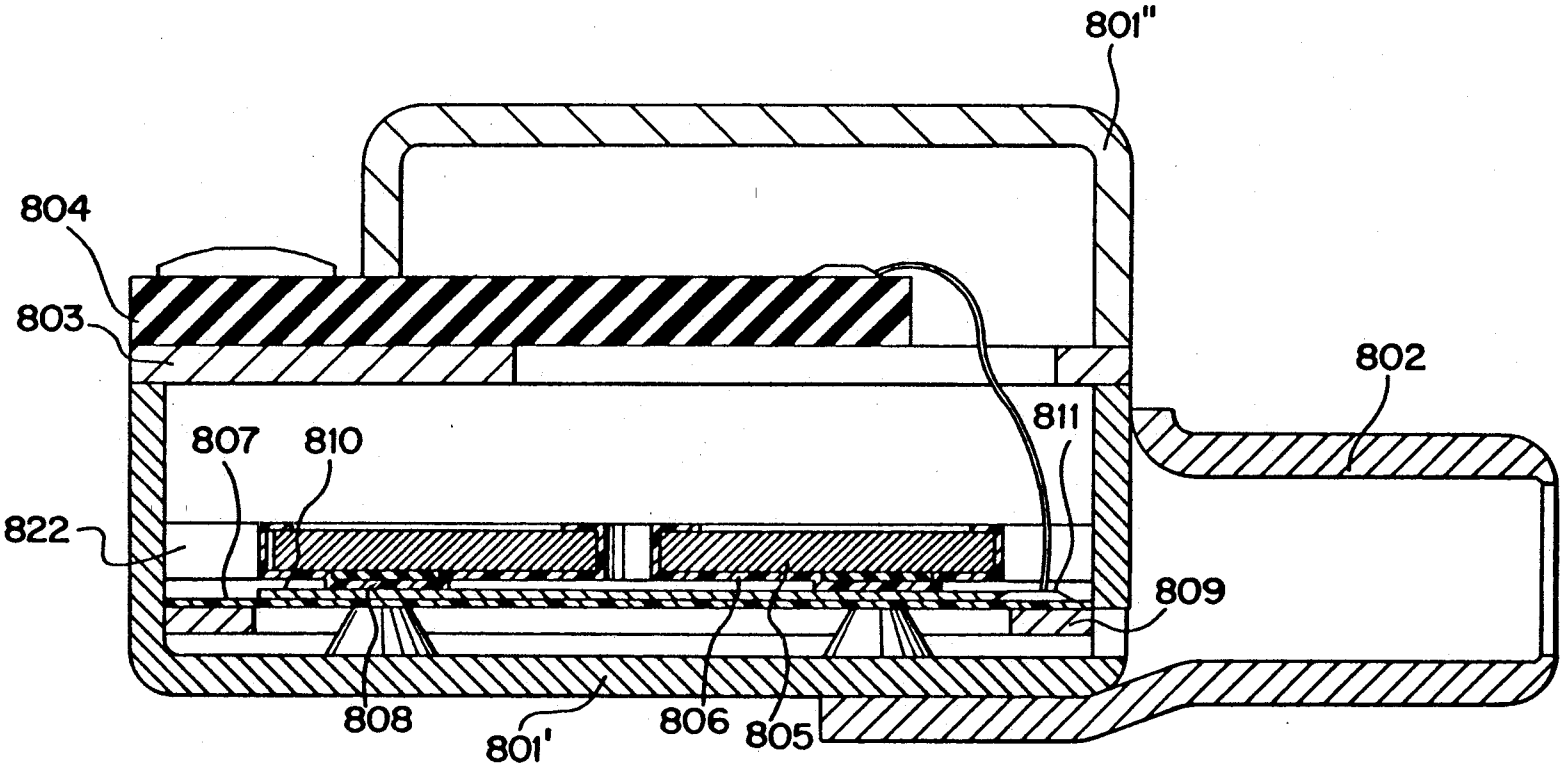
FIG. 8 is a side elevation in cross-section of a seventh embodiment of the transducer according to the invention.
Figure 9:
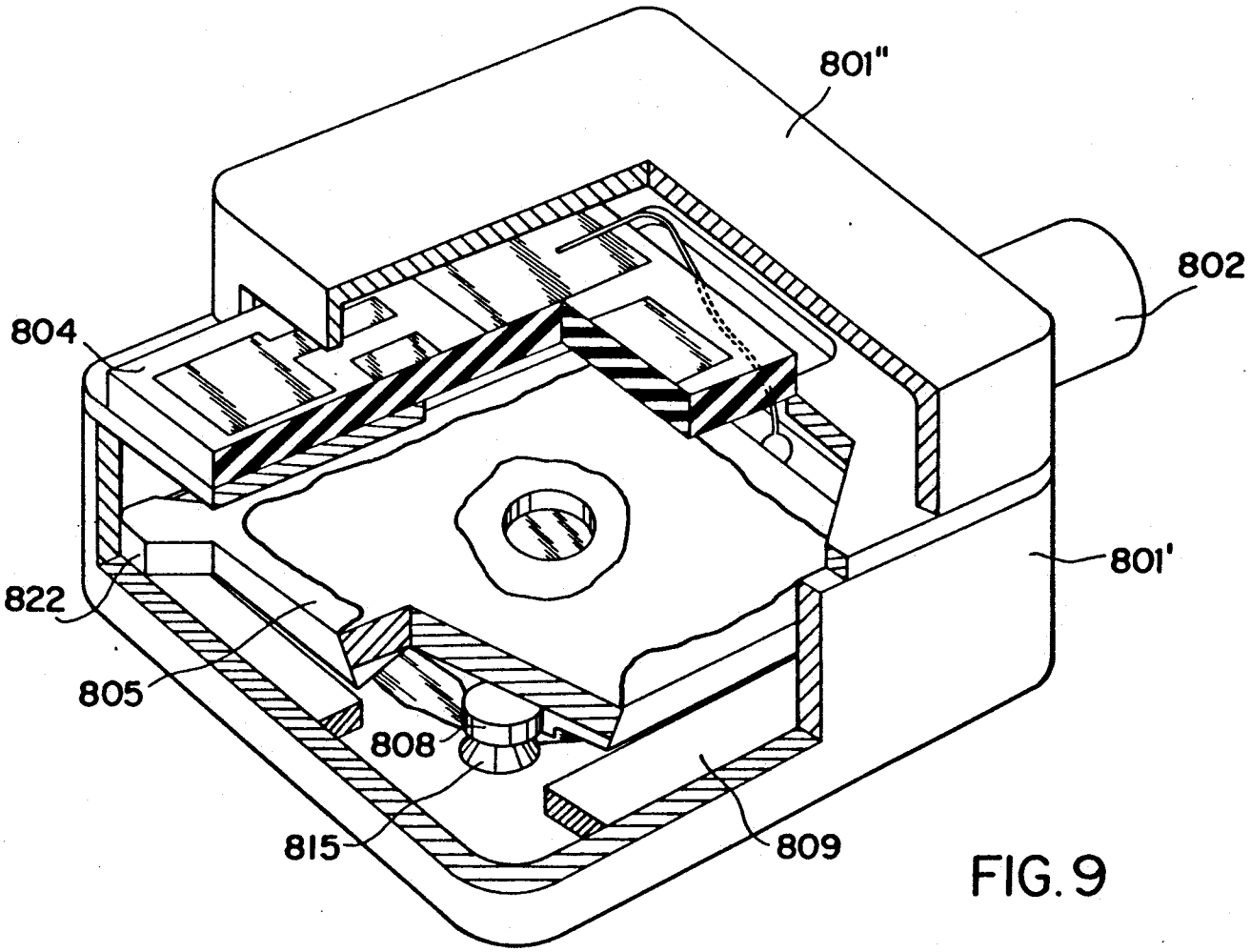
FIG. 9 is a perspective view of the transducer shown in FIG. 8.

FIGS. 8 and 9 show an embodiment in which the backplate 805 is arranged above the diaphragm 807 in the case 801, but, via ribs 822, is still electrically conductively connected with the case as is the annular support 809. The diaphragm 807 is now spaced relative to the bottom of the case by spacer elements 823. This embodiment has the advantage that the damping of the transducer, which is determined by the size of the hole 814 in the middle of the backplate and the space around the backplate, can be considerably smaller because a considerably larger free space is present around the backplate. Slight damping is favourable for the reduction of the amount of noise produced by the transducer. A second advantage is that the sensitivity of the transducer in relation to the dimensions of the case can be optimal in that the backplate can extend as far as the inside edge of the annular support and the metal layer on the diaphragm can also extend as far as that point. Thus, the variable capacitance has a maximum surface and a high sensitivity is obtained.

Figure 10:
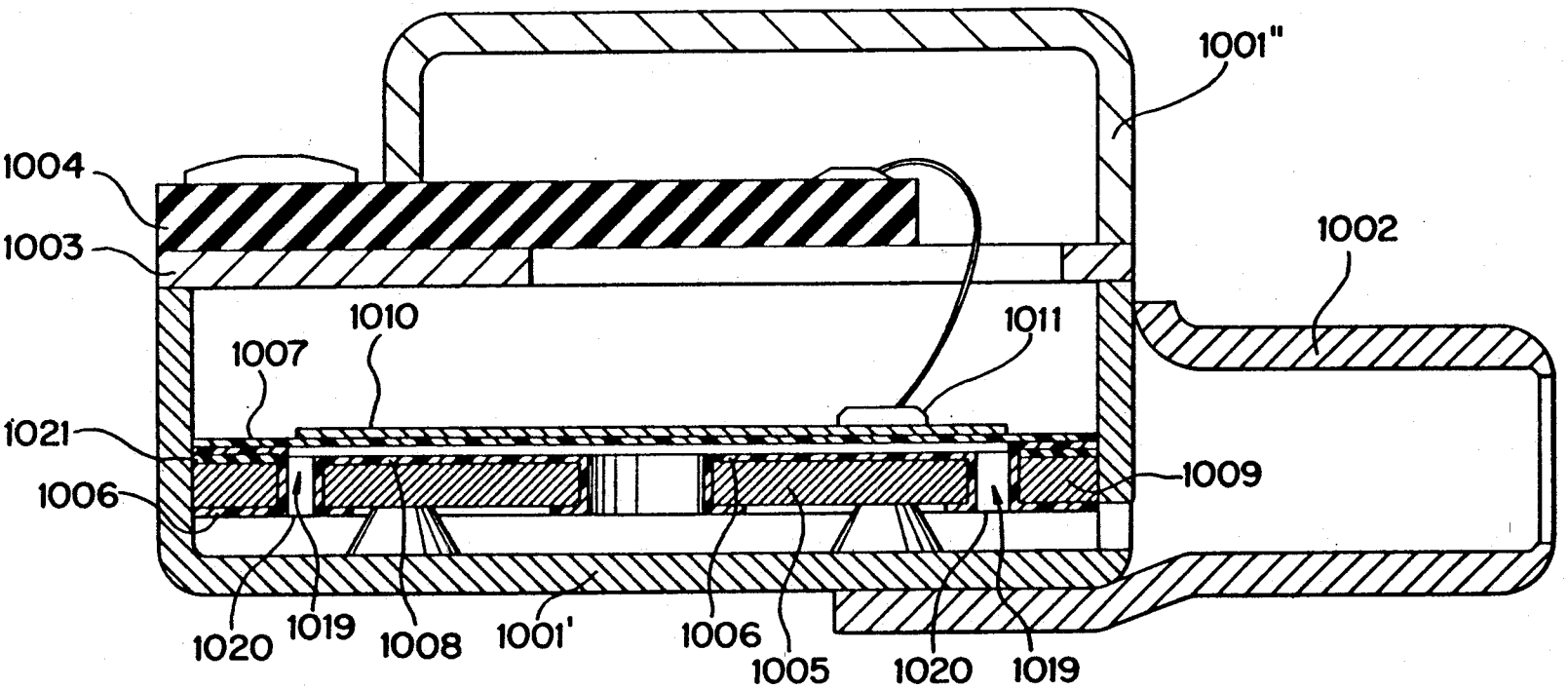
FIG. 10 is a side elevation in cross-section of an eighth embodiment of a transducer according to the invention.

FIG. 10, finally, shows a variant of the embodiment according to FIG. 7. This embodiment has the advantage that there are no spacing members 708 present between the diaphragm and the backplate. This has production-technical advantages. Although in principle the members 108 in the embodiment according to FIG. 1 can also be omitted, this is particularly advantageous in the embodiment according to FIG. 7 because in that embodiment, in which the backplate 705 and the annular support 709 form one whole, the distance between the diaphragm and the backplate can be accurately fixed beforehand. In the known transducer, the omission of spacers between the diaphragm and the backplate is not possible because the backplate is attached to the annular support only at the corners, so that the omission of the spacers would lead to problems. In the present invention, both the backplate and the annular support are welded to the case, so that a very stable whole is obtained.

I claim:

1. An electroacoustic transducer of the electret type, comprising a case having an opening via which the interior of the case communicates with the surroundings; a backplate and a diaphragm arranged opposite the backplate in the case, said backplate having a surface provided at least partly with an electret material, said diaphragm having a surface, a part of said surface of the diaphragm being provided with an electrically conductive layer; means for securing the circumference of the diaphragm to the inside wall of the case, and the backplate and the means for securing the diaphragm to the inside wall of the case are both electrically connected with the case and thereby have the same potential as the case.

2. An electroacoustic transducer according to claim 1, in which a wall of the case constitutes the bottom thereof and the means for securing the circumference of the diaphragm to the inside wall of the case consists of an annular element, the backplate is arranged most closely to said bottom of said case, said annular element having a surface that faces away from said bottom, spacing means are provided for spacing the backplate from the bottom at a predetermined distance and the diaphragm is secured to said surface of the annular element that faces away from the bottom.

3. An electroacoustic transducer according to claim 2, including spacer elements of an insulating material provided between the backplate and the diaphragm, said spacer elements also being covered with electret material.

4. An electroacoustic transducer according to claim 3, including deepened portions formed in the surface of the backplate that faces the diaphragm, and said spacer elements extending into said deepened portions.

5. An electroacoustic transducer according to claim 4, including projecting portions on the opposite surface of the backplate, which projecting portions have been formed as the deepened portions were provided and function as the spacing means.

6. An electroacoustic transducer according to claim 2, in which said backplate consists of silicon and the electret material consists of silicon oxide which has been formed on the surface of the backplate.

7. An electroacoustic transducer according to claim 6, in which said spacing means are integral with the backplate and are also covered with silicon oxide.

8. An electroacoustic transducer according to claim 2, in which said backplate and the annular element have been fabricated together from a metal sheet, are connected to each other and are both covered with electret material.

9. An electroacoustic transducer according to claim 3, including an electrical terminal formed on the electrically conductive layer provided on the diaphragm near a spacer element.

10. An electroacoustic transducer according to claim 3, including an electrical terminal formed on a tab portion of said electrically conductive layer provided on the diaphragm that is located near a sidewall of the case.

11. An electroacoustic transducer according to claim 3, in which no electrically conductive layer is provided on said diaphragm at the location of the spacer elements.

12. An electroacoustic transducer according to claim 1, in which a wall of the case constitutes the bottom thereof and the means for securing the circumference of the diaphragm to the inside wall of the case consists of an annular element, said diaphragm is arranged most closely to said bottom of said case, said annular element having a surface that faces away from said bottom, spacing means are provided for spacing the diaphragm from the bottom at a predetermined distance and the diaphragm is secured to said surface of the annular element that faces away from the bottom.

13. An electroacoustic transducer according to claim 12, including spacer elements of an insulating material provided between the backplate and the diaphragm, said spacer elements also being covered with electret material.

14. An electroacoustic transducer according to claim 2, in which said backplate having a surface that faces the bottom, said surface that faces the bottom being provided with deepened portions which accommodate said spacing means in order to position the backplate relative to the case.

* * * * *